US010773127B2

(12) United States Patent
Goolesby

(10) Patent No.: US 10,773,127 B2
(45) Date of Patent: Sep. 15, 2020

(54) CLIMBING GAFF

(71) Applicant: Jonathan Luke Goolesby, Flat Rock, AL (US)

(72) Inventor: Jonathan Luke Goolesby, Flat Rock, AL (US)

( * ) Notice: Subject to any disclaimer, the term of this patent is extended or adjusted under 35 U.S.C. 154(b) by 76 days.

(21) Appl. No.: 15/911,919

(22) Filed: Mar. 5, 2018

(65) Prior Publication Data

US 2018/0272192 A1 Sep. 27, 2018

Related U.S. Application Data

(60) Provisional application No. 62/475,630, filed on Mar. 23, 2017.

(51) Int. Cl.
*A63B 27/02* (2006.01)
*A63B 71/00* (2006.01)

(52) U.S. Cl.
CPC ..... *A63B 27/02* (2013.01); *A63B 71/0054* (2013.01); *A63B 2209/10* (2013.01); *A63B 2225/09* (2013.01)

(58) Field of Classification Search
CPC ..... A63B 27/00; A63B 27/02; A63B 27/04
See application file for complete search history.

(56) References Cited

U.S. PATENT DOCUMENTS 628,070 A * 7/1899 Butler ..... A63B 27/02 182/221
1,150,372 A * 8/1915 Jones ..... A63B 27/02 182/221
1,335,945 A * 4/1920 Frisbie ..... A63B 27/02 182/221
1,505,360 A * 8/1924 Lowery ..... A63B 29/02 182/134
1,983,526 A * 12/1934 Bailey ..... A63B 27/02 182/221
2,391,810 A * 12/1945 Webber ..... A63B 27/02 182/221
4,153,139 A * 5/1979 Houch ..... A63B 27/02 182/134
4,530,420 A * 7/1985 Hobbs ..... A63B 27/02 182/134
4,620,610 A * 11/1986 Southard ..... A63B 27/00 182/228.1

(Continued)

*Primary Examiner* — Katherine W Mitchell
*Assistant Examiner* — Shiref M Mekhaeil
(74) *Attorney, Agent, or Firm* — Boudwin Intellectual Property; Daniel Boudwin

(57) ABSTRACT

The present invention provides a climbing gaff. The climbing gaff includes an elongated member having a horizontal member extending perpendicularly therefrom, and a spur affixed opposed to the horizontal member. A pair of brackets are angularly affixed to a central portion of the elongated member, wherein each bracket extends downwardly and includes an arm extending perpendicularly from a lower end thereof. A pair of adjustable foot plates are secured to the arms of the brackets, such that the foot plates are perpendicular disposed in relation to the elongated member. A belt is affixed to the horizontal member, wherein the belt includes a pair of distal ends that removably secure around a foot and ankle of a user. A strap is affixed to the upper end of the elongated member, wherein the strap removably secures to a leg of a user.

15 Claims, 3 Drawing Sheets

(56) References Cited

U.S. PATENT DOCUMENTS

| | | | | | |
|---|---|---|---|---|---|
| 4,730,702 | A * | 3/1988 | Torbett | A63B 27/02 | 182/134 |
| 4,993,515 | A * | 2/1991 | Green | A63B 27/02 | 182/134 |
| 5,016,734 | A * | 5/1991 | Greenway | A63B 27/00 | 182/134 |
| 5,853,067 | A * | 12/1998 | Cutler | A63B 27/02 | 182/221 |
| 5,881,837 | A * | 3/1999 | Leicht | A63B 27/00 | 182/90 |
| 6,148,959 | A * | 11/2000 | Shay | A63B 27/02 | 182/134 |
| 6,405,832 | B1 * | 6/2002 | Willis | A63B 27/02 | 182/134 |
| 6,439,343 | B1 * | 8/2002 | Jorges | E06C 9/04 | 182/187 |
| 6,578,668 | B2 * | 6/2003 | Haltom | A63B 27/02 | 182/134 |
| 6,845,846 | B1 * | 1/2005 | Gragnano | A63B 27/02 | 182/134 |
| 7,070,022 | B1 * | 7/2006 | Diggle, III | A63B 27/02 | 182/134 |
| 7,727,173 | B2 * | 6/2010 | Rooney | A61F 5/0111 | 602/23 |
| 8,733,505 | B2 * | 5/2014 | Paquet | A63B 27/02 | 182/134 |
| 9,821,192 | B2 * | 11/2017 | Rullo | A63B 27/02 | |
| 2014/0014440 | A1 * | 1/2014 | Monnig | A63B 27/02 | 182/221 |
| 2014/0026445 | A1 * | 1/2014 | Schlichte | A43C 15/00 | 36/136 |

* cited by examiner

CLIMBING GAFF

CROSS REFERENCE TO RELATED APPLICATION

This application claims the benefit of U.S. Provisional Application No. 62/475,630 filed on Mar. 23, 2017. The above identified patent application is herein incorporated by reference in its entirety to provide continuity of disclosure.

BACKGROUND OF THE INVENTION

The present invention relates to climbing spurs and gaffs. More specifically, the present invention provides a climbing gaff that includes a pair of brackets that support a pair of adjustable foot plates thereon. The foot plates are designed to evenly distribute pressure resulting from a user's weight throughout the entire foot, which in turn provides a more comfortable climbing experience.

Many people wear climbing gaffs or spurs on their feet when climbing trees or utility poles. The spurs are inserted into the surface of the tree or pole to aide a user while climbing. When using standard climbing gaffs, pressure and strain are placed on the feet due to limited surface area support. Thus, climbers experience pain in their feet, knees, hips, and back, when using standard gaffs. People who climb often suffer debilitating knee injuries and can require corrective knee surgery or total knee replacement in later years. In order to address these concerns, the present invention provides a climbing gaff having a pair of adjustable foot supports to provide an increased surface area for supporting a user's body weight.

Devices have been disclosed in the prior art that relate to climbing gaffs and spurs. These include devices that have been patented and published in patent application publications. These devices generally relate to improvements for climbing gaffs. One device includes a rotatable stirrup and leg support attached to the climbing gaff, wherein a plurality of replaceable spurs are attached to a bottom surface of the stirrup. Another device includes a gaff shield for protecting a portion of a leg and foot while in use. While another climbing gaff includes a supporting surface for the bottom of the instep and the sole of the foot that is movable while walking. Another device includes a pair of support bars attached to the gaff in order to support a user's foot. Lastly, one device includes a boot within an integrated spur and shaft arrangement.

These prior art devices have several known drawbacks. These devices fail to include a climbing gaff having a pair of adjustable foot plates that can support and distribute a user's weight. Further, these devices fail to include foot plates that include a raised sidewall on the front and rear edges that secure the user's foot within the pair of foot plates. Lastly, many of these devices lack a pair of brackets that are angularly secured to the shaft of a climbing gaff, such that the brackets support and secure the pair of adjustable foot plates.

In light of the devices disclosed in the known art, it is submitted that the present invention substantially diverges in design elements from the known art and consequently it is clear that there is a need in the art for an improvement to existing climbing gaff devices. In this regard the instant invention substantially fulfills these needs.

SUMMARY OF THE INVENTION

In view of the foregoing disadvantages inherent in the known types of climbing gaffs and spurs now present in the prior art, the present invention provides a new climbing gaff wherein the same can be utilized for providing convenience for the user when supporting and distributing the user's weight across a pair of adjustable foot plates while climbing a tree or utility pole.

It is therefore an object of the present invention to provide a new and improved climbing gaff that has all of the advantages of the prior art and none of the disadvantages.

It is another object of the present invention to provide a climbing gaff comprising an elongated member having an upper end and a lower end, wherein the lower end includes a horizontal member extending perpendicularly therefrom. A spur is affixed to the lower end of the elongated member opposed to the horizontal member. A belt is affixed at a first end of the horizontal member, wherein the belt includes a pair of distal ends having a fastener thereon, such that the pair of distal ends removably secure to one another to form a loop around a user's foot and ankle, and a strap affixed to the upper end of the elongated member, wherein the strap includes a pair of distal ends having a fastener thereon, such that the pair of distal ends removably secure to each other to form a loop around a user's leg. The elongated member further includes a pair of brackets, wherein each bracket includes an upper end that is angularly affixed to a central portion of the elongated member and an arm extending perpendicularly from a lower end thereof. The pair of brackets include a first foot plate that is removably secured to an arm of a first bracket and a second foot plate that is removably secured to an arm of a second bracket, such that each the first foot plate and the second foot plate are perpendicular disposed in relation to the elongated member a pair of brackets.

Another object of the present invention is to provide a climbing gaff wherein the first foot plate and the second foot plate each include a plurality of apertures, wherein the plurality of apertures are arranged in evenly spaced rows.

Yet another object of the present invention is to provide a climbing gaff, wherein the first foot plate includes a perimeter configured to substantially conform to a toe portion of a sole of a shoe and the second foot plate includes a perimeter configured to substantially conform to a heel portion of a sole of a shoe. The first foot plate further includes a sidewall that extends upwardly from a toe end thereof, and the second foot plate further includes a sidewall that extends from the heel end thereof.

Another object of the present invention is to provide a climbing gaff that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
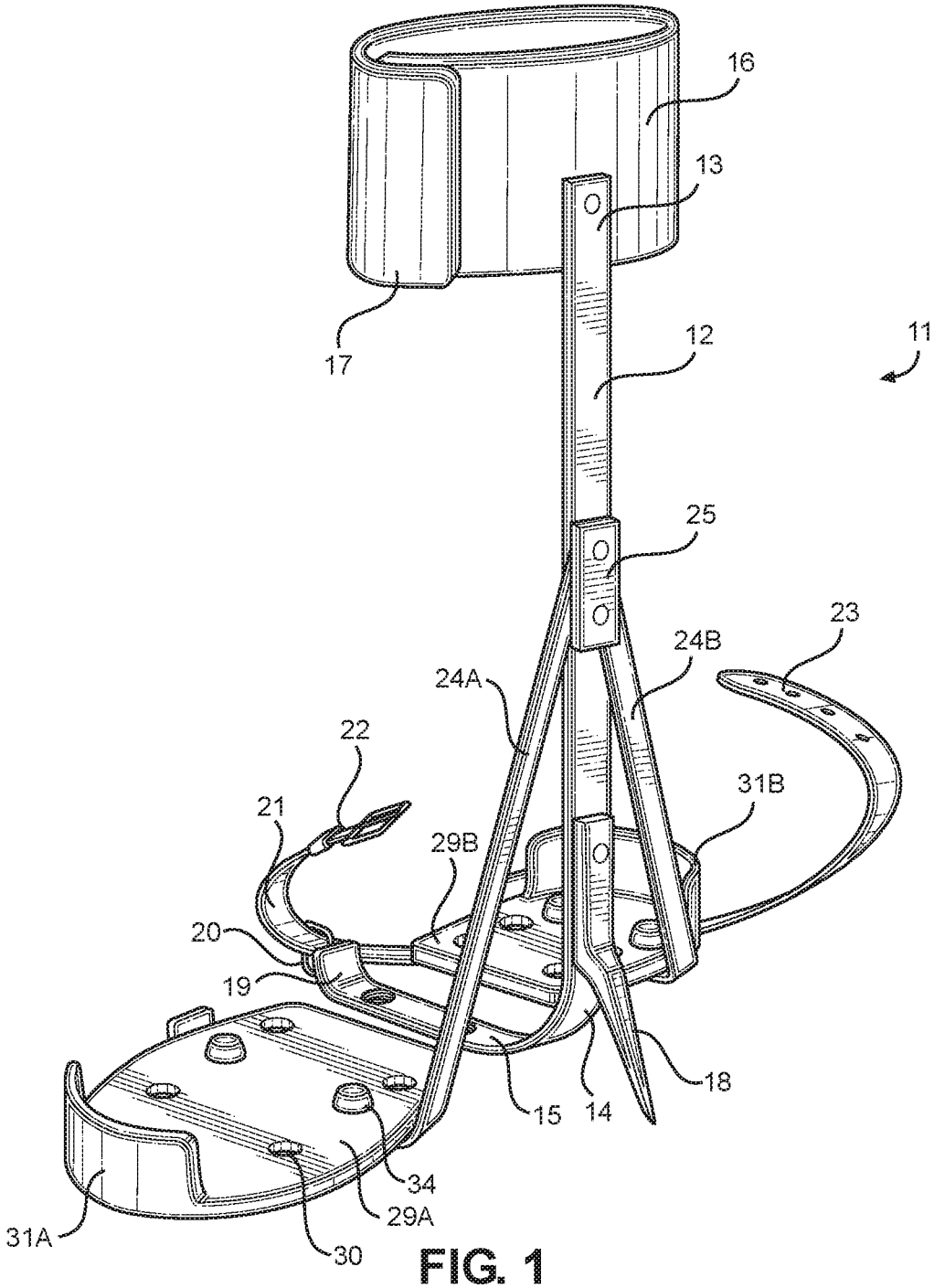
FIG. 1 shows a perspective view of an embodiment of the climbing gaff.

Reference is made herein to the attached drawings. Like reference numerals are used throughout the drawings to depict like or similar elements of the climbing gaff. For the purposes of presenting a brief and clear description of the present invention, the preferred embodiment will be discussed as used for climbing a tree or a utility pole. Specifically, it is contemplated that a user will wear a pair of climbing gaffs when in use. However, for simplicity purposes, the description will refer to a single climbing gaff in most instances. The figures are intended for representative purposes only and should not be considered to be limiting in any respect.

Referring now to FIG. 1, there is shown a perspective view of an embodiment of the climbing gaff. The climbing gaff 11 comprises an elongated member 12 having an upper end 13 and a lower end 14, wherein the lower end 14 includes a horizontal member 15 that extends perpendicularly therefrom. In the illustrated embodiment, the elongated member 12 and horizontal member 15 comprise a J shape, wherein the horizontal member 15 is configured to receive an arch of a user's foot.

In the illustrated embodiment, a first end 19 of the horizontal member 15 extends upwardly therefrom, wherein the first end 19 includes a fastener 20 that receives a belt 21. The belt 21 includes a pair of distal ends 23 each having a fastener 22 thereon, such that the distal ends 23 are configured to removably secure to each other to form a loop around a user's foot and ankle, thereby securing the climbing gaff 11 thereto. In the illustrated embodiment, the fastener 22 on the belt 21 is a buckle and aperture arrangement. However, any suitable fastener may be used. The belt 21 comprises a bendable material, such as, nylon or leather, whereby the belt 21 can be looped and tightened around the user's foot and ankle.

The elongated member 14 further includes a spur 18 affixed to the lower end 14 opposing to the horizontal member 15. In the illustrated embodiment, the spur 18 is angularly disposed, wherein the point of the spur 18 extends downwardly from the lower end 14. The spur 18 is configured to be received within a surface, such as a tree trunk or utility pole. In this way, the spur 18 engages with the surface such that a user's weight is supported by the climbing gaff 11 when worn.

In the illustrated embodiment, the upper end 13 of the elongated member 12 includes a strap 16 affixed thereto. The strap 16 includes a pair of distal ends 17 each having a fastener thereon, such that the pair of distal ends 17 removably secure to each other to form a loop. The fastener on each distal end 17 may be any suitable fastener, such as, a belt and buckle, or hook and loop material. The strap 16 is configured to removably secure to a user's leg, such that the elongated member 12 rests flush against the leg. The combination of the strap 16 and the belt 21 secure the climbing gaff 11 to the user's leg and foot, respectively. The strap 16 is constructed of a bendable material, such as, nylon or leather, wherein it can be wrapped around the user's leg.

Figure 2:
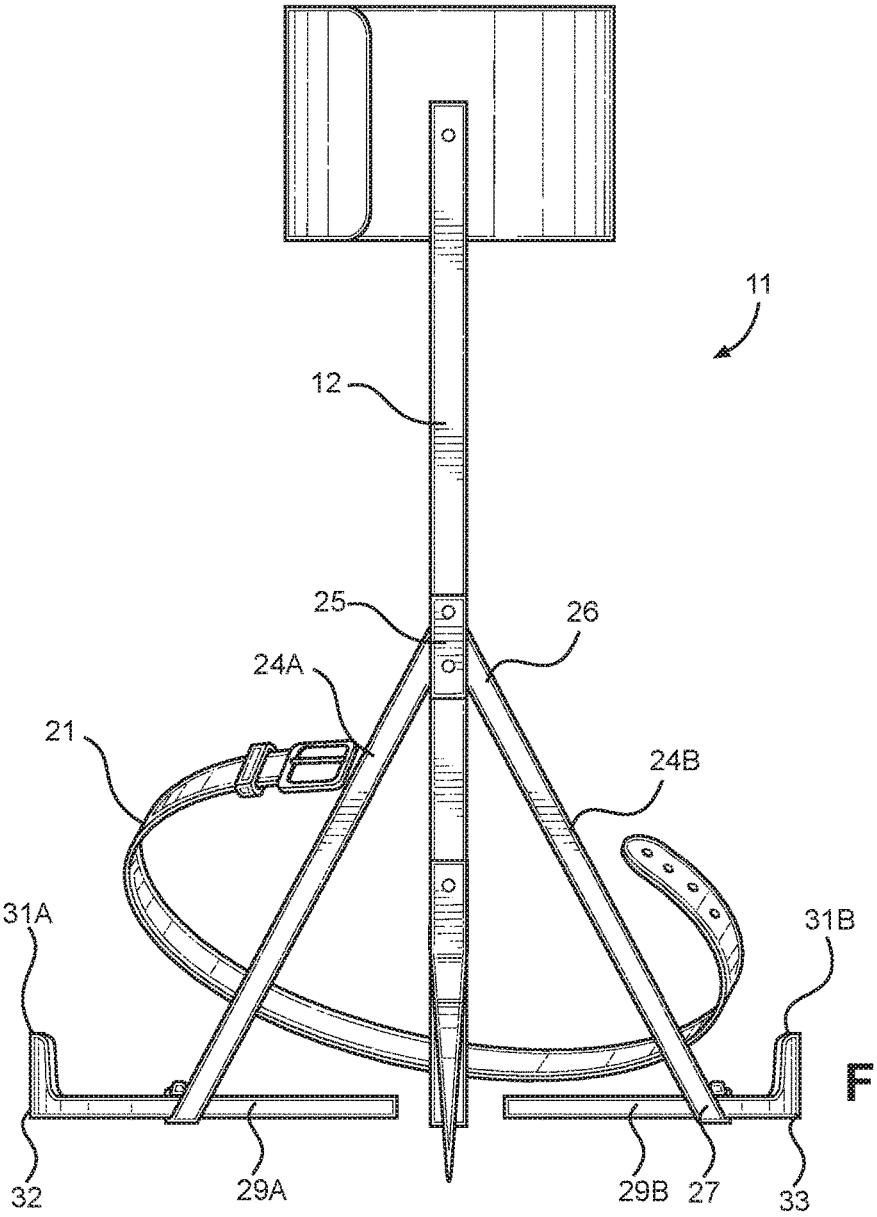
FIG. 2 shows a side view of an embodiment of the climbing gaff.
Figure 3:
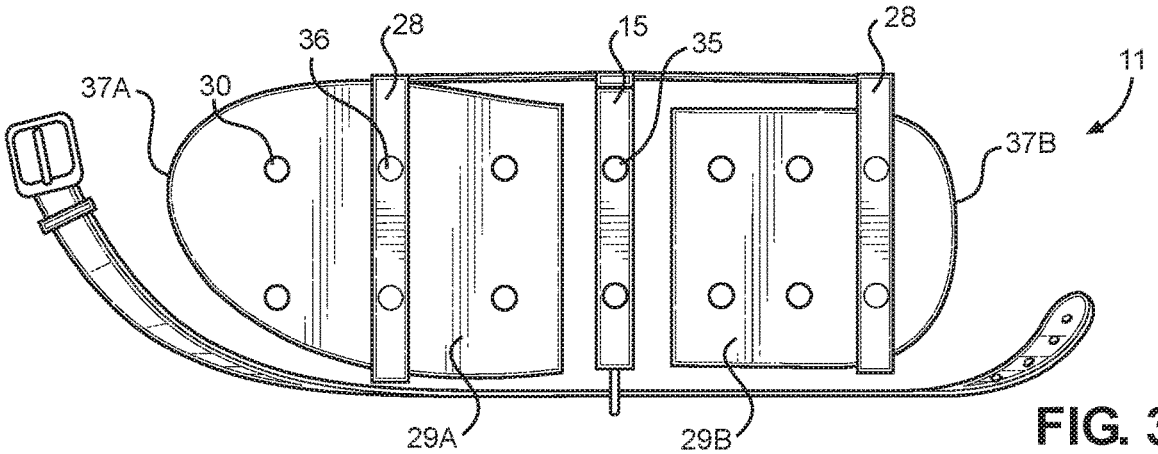
FIG. 3 shows a bottom view of an embodiment of the climbing gaff.

Referring now to FIG. 1, FIG. 2 and FIG. 3, there is shown a perspective view of an embodiment of the climbing gaff, a side view of an embodiment of the climbing gaff, and a bottom view of an embodiment of the climbing gaff, respectively. The climbing gaff 11 includes a pair of brackets 24 that are angularly affixed to a central portion 25 of the elongated member 12, wherein the brackets 24 extend downwardly therefrom. Each bracket 24 includes an upper end 26 and a lower end 27, wherein each lower end 27 includes an arm 28 extending perpendicularly therefrom. Each arm 28 is configured to removably secure a foot plate 29. Each arm 28 is disposed on lateral sides of the horizontal member 15, such that the arms 28 and the horizontal member 15 are in parallel.

In the illustrated embodiment, a first foot plate 29A is secured to an arm 28 of a first bracket 24A, and a second foot plate 29B is secured to an arm 28 of the second bracket 24B. Each foot plate 29 is disposed perpendicularly in relation to the elongated member 12. Each of the foot plates 29 include a plurality of apertures 30, wherein the plurality of apertures 30 are configured to receive a fastener 34, such that the foot plates 29 removably secure to the arms 28 of the brackets 24. The fastener 34 may be any suitable fastener, such as, a bolt or a screw. In the illustrated embodiment, both the arms 28 of the brackets 24 and the horizontal member 15 include a plurality of openings, such that the foot plates 29 can be secured thereto. In alternative embodiments, it is contemplated that the brackets 24 are configured to removably secure to any standard gaff, such that the brackets 24 and foot plates 29 can be affixed thereto.

In the illustrated embodiment, each foot plate 29 includes a sidewall 31 extending upwardly from an end thereof, such that the first foot plate 29A includes a sidewall 31A that extends upwardly from a toe end 32 thereof, and the second foot plate 29B includes a sidewall 31B that extends from a heel end 33 thereof. In the illustrated embodiment, each sidewall 31 includes a curved shape, such that the sidewall 31A at the toe end 32 is configured to rest flush with a toe portion of a shoe and the sidewall 31B at the heel end 33 is configured to rest flush with the heel portion of a shoe. In this way, each sidewall 31 further secures a user's shoe, such that the foot plates 29 of the climbing gaff 11 fit tightly therearound, thereby preventing movement of the climbing gaff 11 when worn.

In the illustrated embodiment, each foot plate 29 includes a perimeter 37 that substantially conforms to the sole of a user's shoe. The first foot plate 29A includes a perimeter 37A that matches the front toe portion of the sole, while the second foot plate 29B includes a perimeter 37B that matches the heel portion of the sole. In this way, each foot plate 29 is configured to distribute pressure evenly throughout the foot of the user, which in turn improves support for the user's feet, knees, hips, and back. Furthermore, each foot plate 29 is configured to be adjustable, such that the plurality of apertures 30 on each foot plate 29 can be aligned with the plurality of openings 35, 36 on each arm 28 or the horizontal member 15, respectively. In this way, the foot plates 29 can be adjusted to fit a particular size of foot for increased comfort, such that a user with larger feet can separate the foot plates 29 away from each other when worn, while a user with smaller feet can align the foot plates 29 closer together.

Figure 4:
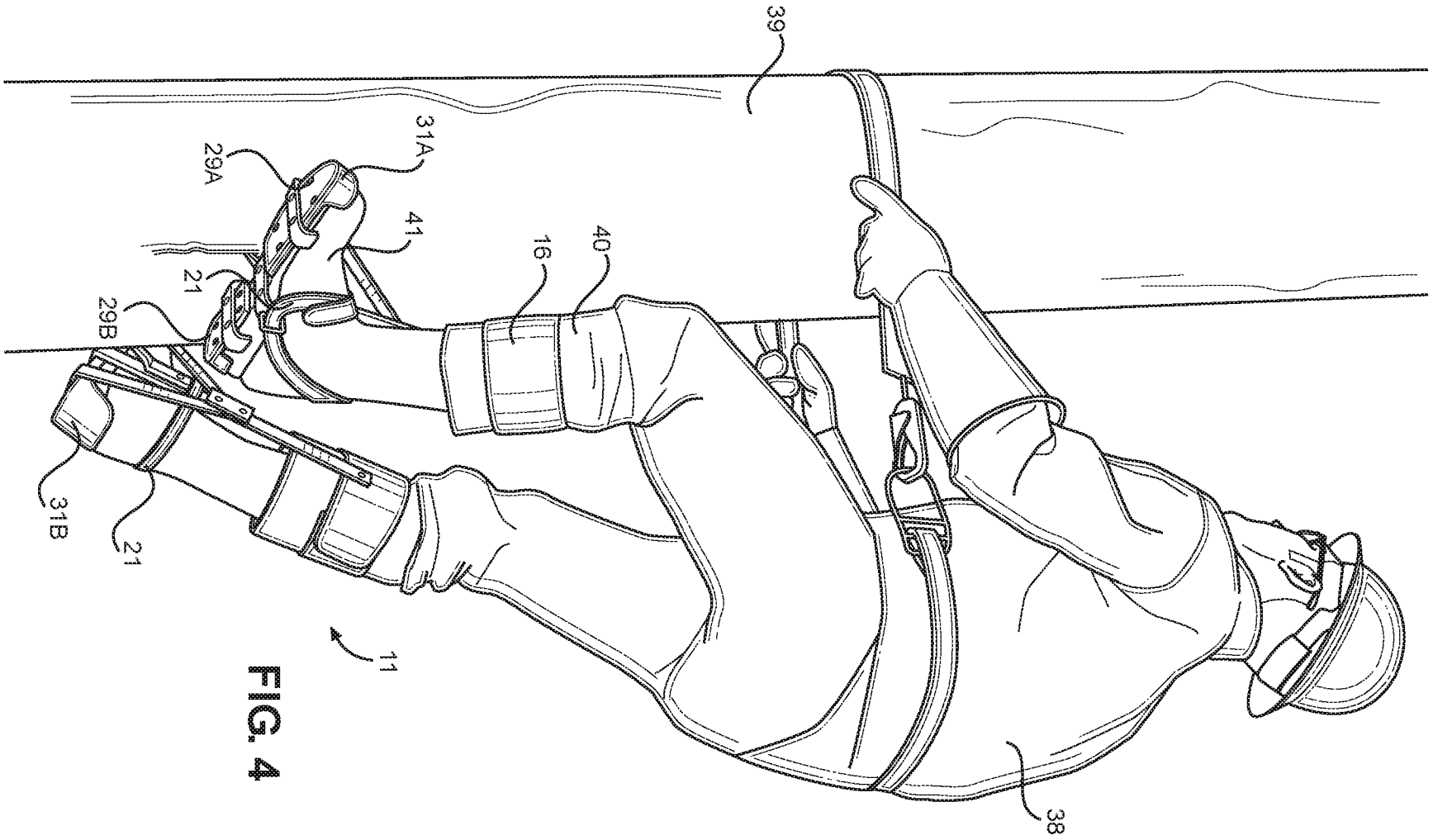
FIG. 4 shows a perspective view of an embodiment of the climbing gaff, wherein a pair of climbing gaffs are secured to a user.

Referring now to FIG. 4, there is shown a perspective view of an embodiment of the climbing gaff, wherein a pair of climbing gaffs are secured to a user. It is contemplated that a user 38 will wear a pair of climbing gaffs 11, wherein each climbing gaff 11 is configured to fit the left and right foot 41 of the user 38. In use, the user 38 will adjust the foot plates 29A, 29B to fit their shoe size, such that the sidewall 31A of the first plate 29A rests flush against the toe of the shoe and the sidewall 31B of the second foot plate 29B rests flush against the heel of the shoe, in order to provide a tight fit.

Once the foot plates 29 are adjusted to the desired fit, the user will secure the strap 16 of the gaff 11 to their leg 40 and secure the belt 21 to their foot 41 and ankle area. Once secured, the user can engage the spur of each climbing gaff 11 with the surface of an object 39, such as, a tree or a utility pole. While climbing, the foot plates 29 provide and increased surface area for distributing the pressure resulting from the user's body weight, thereby increasing the comfort when climbing and providing an improved and safer mechanism for climbing trees and poles.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A climbing gaff, comprising:

an elongated member having an upper end and a lower end, wherein the lower end includes a horizontal member extending perpendicularly therefrom;

a spur affixed to the lower end of the elongated member opposed to the horizontal member;

a belt affixed at a first end of the horizontal member, wherein the belt includes a pair of distal ends each having a fastener thereon, such that the pair of distal ends removably secure to one another to form a loop;

a strap affixed to the upper end of the elongated member, wherein the strap includes a pair of distal ends each having a fastener thereon, such that the pair of distal ends removably secure to each other to form a second loop;

a pair of brackets, wherein each bracket includes an upper end that is angularly affixed to a central portion of the elongated member and an arm extending perpendicularly from a lower end thereof; and a pair of discontinuous foot plates, wherein a first foot plate of the pair of foot plates is removably secured to the arm of a first bracket of the pair of brackets and a second foot plate of the pair of foot plates is removably secured to the arm of a second bracket of the pair of brackets, such that each of the first foot plate and the second foot plate are perpendicularly disposed in relation to the elongated member.

2. The climbing gaff of claim 1, wherein the first foot plate and the second foot plate each include a plurality of apertures.

3. The climbing gaff of claim 2, wherein the plurality of apertures are arranged in evenly spaced rows.

4. The climbing gaff of claim 1, wherein the first foot plate includes a perimeter configured to substantially conform to a toe portion of a sole of a shoe, and the second foot plate includes a perimeter configured to substantially conform to a heel portion of the sole of the shoe.

5. The climbing gaff of claim 4, wherein the first foot plate includes a sidewall that extends upwardly from a toe end thereof, and the second foot plate includes a sidewall that extends upwardly from a heel end thereof.

6. The climbing gaff of claim 5, wherein the sidewall of the first foot plate includes a curve configured to rest flush with the toe portion of the shoe, and the sidewall of the second foot plate includes a curve configured to rest flush with the heel portion of the shoe.

7. The climbing gaff of claim 1, wherein the arm of each of the pair of brackets includes a plurality of openings.

8. The climbing gaff of claim 1, wherein the horizontal member includes a plurality of openings.

9. The climbing gaff of claim 1, wherein the spur is angularly disposed such that a point of the spur extends downwardly from the lower end of the elongated member.

10. The climbing gaff of claim 1, wherein the fastener on the pair of distal ends of the belt comprises a buckle and an aperture arrangement.

11. The climbing gaff of claim 1, wherein the fastener on the pair of distal ends of the strap comprises hook and loop material.

12. The climbing gaff of claim 1, wherein the first foot plate and the second foot plate are discontinuous.

13. The climbing gaff of claim 1, wherein the first foot plate and the second foot plate are coplanar.

14. A climbing gaff, comprising:

an elongated member having an upper end and a lower end, wherein the lower end includes a horizontal member extending perpendicularly therefrom;

a spur affixed to the lower end of the elongated member opposed to the horizontal member;

a belt affixed at a first end of the horizontal member, wherein the belt includes a pair of distal ends each having a fastener thereon, such that the pair of distal ends removably secure to one another to form a loop;

a strap affixed to the upper end of the elongated member, wherein the strap includes a pair of distal ends each having a fastener thereon, such that the pair of distal ends removably secure to each other to form a second loop;

a pair of brackets, wherein each bracket includes an upper end that is angularly affixed to a central portion of the elongated member and an arm extending perpendicularly from a lower end thereof;

a pair of discontinuous foot plates, each having a plurality of apertures therethrough;

wherein a first foot plate of the pair of foot plates is removably secured to the arm of a first bracket of the pair of brackets via the plurality of apertures and a second foot plate of the pair of foot plates is removably secured to the arm of a second bracket of the pair of brackets via the plurality of apertures;

wherein the first foot plate and the second foot plate are removably securable along different apertures of the plurality of apertures, such that a linear distance between the first foot plate and the second foot plate is adjustable;

wherein each of the first foot plate and the second foot plate are perpendicularly disposed in relation to the elongated member when secured to the first and second brackets.

15. A climbing gaff, consisting of:

an elongated member having an upper end and a lower end, wherein the lower end includes a horizontal member extending perpendicularly therefrom;

a spur affixed to the lower end of the elongated member opposed to the horizontal member;

a belt affixed at a first end of the horizontal member, wherein the belt includes a pair of distal ends each having a fastener thereon, such that the pair of distal ends removably secure to one another to form a loop;

a strap affixed to the upper end of the elongated member, wherein the strap includes a pair of distal ends each having a fastener thereon, such that the pair of distal ends removably secure to each other to form a second loop;

a pair of brackets, wherein each bracket includes an upper end that is angularly affixed to a central portion of the elongated member and an arm extending perpendicularly from a lower end thereof;

a pair of discontinuous foot plates, each having a plurality of apertures therethrough;

wherein a first foot plate of the pair of foot plates is removably secured to the arm of a first bracket of the pair of brackets via the plurality of apertures and a second foot plate of the pair of foot plates is removably secured to the arm of a second bracket of the pair of brackets via the plurality of apertures;

wherein the first foot plate and the second foot plate are removably securable along different apertures of the plurality of apertures, such that a linear distance between the first foot plate and the second foot plate is adjustable;

wherein each of the first foot plate and the second foot plate are perpendicularly disposed in relation to the elongated member when secured to the first and second brackets.

* * * * *